US005339670A

United States Patent [19]

Granelli

[11] Patent Number: 5,339,670

[45] Date of Patent: Aug. 23, 1994

[54] APPARATUS AND METHOD FOR BENDING TUBING

[76] Inventor: Anthony Granelli, P.O. Box 1415, Lake Jackson, Tex. 77566

[21] Appl. No.: 65,410

[22] Filed: May 24, 1993

[51] Int. Cl.[5] ..... B21D 7/04

[52] U.S. Cl. ..... 72/152; 72/154; 72/369

[58] Field of Search ..... 72/152, 159, 149, 154, 72/155, 150, 151, 369, 387, 388

[56] References Cited

U.S. PATENT DOCUMENTS

| | | | |
|---|---|---|---|
| 2,882,953 | 4/1959 | Huet | 72/159 |
| 2,996,100 | 8/1961 | Newhall et al. | 72/159 |
| 3,155,139 | 11/1964 | Hautau | 72/151 |
| 3,242,710 | 3/1966 | Hamlin | 72/159 |
| 3,261,193 | 7/1966 | Van Harten | 72/159 |
| 3,303,683 | 2/1967 | Schmidt | 72/154 |
| 4,765,168 | 8/1988 | Stange et al. | 72/149 |

FOREIGN PATENT DOCUMENTS

| | | | |
|---|---|---|---|
| 0290622 | 11/1990 | Japan | 72/149 |
| 2053036 | 2/1981 | United Kingdom | 72/150 |

*Primary Examiner*—David Jones

*Attorney, Agent, or Firm*—Kenneth A. Keeling

[57] ABSTRACT

Forming dies adaptable to conventional tube bending machinery, the forming dies including aligned forming rollers engaging the tubing to be bent, said forming rollers containing grooves having curvilinear surfaces said forming rollers initially deforming the said tubing into a first curvilinear shape upon the drawing or pushing of the tubing between the forming rollers. A bend die is aligned with a pressure die roller, the pressure die roller and bend die each containing grooves having curvilinear surfaces defining a second curvilinear shape. Upon drawing or pushing the tubing through the pressure die roller and bend die, a second curvilinear shape is imparted to the tube. The tubing may thus be provided with an enhanced curvilinear shape prior to bending.

11 Claims, 2 Drawing Sheets

APPARATUS AND METHOD FOR BENDING TUBING

BACKGROUND OF THE INVENTION

1. Field of the Invention

This invention relates generally to an apparatus and method for bending of tubing and more particularly to an apparatus and method for preforming of tubing to a desired curvilinear shape to provide for improved quality of tube bend.

2. Description of the Prior Art

Current rotary draw bending of tubes and pipes (pipe will be deemed included herein in references to tube or tubing) contemplates three sets of tools commonly used to form a tube bend. The tools are (i) a rotary bending form, also called a bend die, (ii) a clamp die, and (iii) a pressure die, sometimes referred to as a follower die. In current rotary draw bending practice the tube to be bent is secured between the bend die and the clamp die and aligned against the pressure die. As the bend die rotates, the clamp die rotates with it, the tube being formed in the arc defined by the bend die. The pressure die prevents the trailing portion of the tube from radial movement. The pressure die may remain fixed or it may move forward with the tube to eliminate sliding contact. The pressure die may also include rollers to eliminate sliding contact between the tube and the pressure die.

The quality of the resultant bent tube is determined by the amount of flattening on the outside of the bend, the amount of wall thinning on the outside of the bend, and the existence and degree of wrinkling or buckling on the inside of the bend.

To improve the quality of the bend, a mandrel may be placed on the inside of the tube to support it from flattening and to help prevent wrinkles from forming. Mandrel support of the tube requires use of lubricants to reduce drag, additional tooling to be set and adjusted, cleaning after bending, machine length limitations, and extra time in loading.

Another practice used to improve bend quality is to use multi-radius or parabolic-shaped grooves in each of the pressure die and bend die to contort the tube into a generally elliptical shape during bending. A generally elliptical-shaped tube is more resistant to flattening and wrinkling of the tube during bending. This method allows bends to be made without a mandrel within certain ranges of relationships of outside diameter, wall thickness, and bend centerline radius. The relationship of tube outside diameter to bend centerline radius (CLR) is called the "D" of bend. A 2" O.D. tube bent on a 4" CLR would be a 2×D bend (CLR/O.D.). The smaller the "D" of bend, the greater the wall thickness must be to support the tube during bending to maintain ovality quality requirements. As the wall thickness increases it becomes more difficult to contort the tube into a parabolic shape. As currently practiced, generation of a parabolic shape in the tube requires a relatively high level of pressure die clamping force and may result in deformation of the tube at the entrance to the bend die. An additional die, commonly referred to as a wiper die, may be placed at the inlet to the bend die to overcome the deformation problem. However, the wiper die increases the friction load on the tube and in turn increases susceptibility to buckling or wrinkling.

Rotary draw bending may be accomplished by powered machinery with simple manual controls or operable by computer numerical control (CNC) systems. Such CNC systems include mechanical, electrical and/or hydraulic apparatus for positioning, clamping and rotating the bend die and further include mechanical and hydraulic apparatus for linear propulsion and rotation of the tube.

Machinery and apparatus reflecting the current state of the art of rotary draw bending of tubes is reflected in the following commercial publications:

*Tube and Profile Cold Bending Machines* (catalog), Schwarze-Wirtz K. G., Cologne, W. Germany.

*Computer Controlled Tube Bending and Tube Forming* (catalog), Eagle Precision Technologies, Inc., Ontario, Canada.

*Miic CNC Pipe Bender* (catalog), Chuo Electric Mfg. Co., Ltd. and Tube Tech, Inc., Taylors, S.C.

*Teledyne Pines* (catalog), Teledyne, Aurora, Ill.

*Conrac Bending Equipment for Tube and Pipe* (catalog), Conrac Machine Tool Division, Westminster, Calif.

*Tools for Bending, Inc.* (catalog), Tools for Bending, Inc., Denver, Colo.

*CNC Bender* (catalog), Chiyoda U.S.A., Goodlettsville, Tenn.

Stange, et al. U.S. Pat. No. 4,765,168 discloses a tube bending apparatus in which a tube is clamped between a u-shaped bend die and a cooperating pressure die. The pressure die advances in a linear direction as the bend die is rotated. The tube groove supplied in the pressure die and bend die have cross-sectional radii of curvature corresponding to that of the tube to be bent. The radius of curvature at the interior of the tube groove at the bend section is less than the outside radius of the tube to be bent. The radii of curvature of the sides of the groove tube have a cross-sectional radius of curvature greater than the outside radius of the tube to be bent with the side surfaces undergoing a smooth, gradual transition into the bottom surface. The bend die and linear pressure die disclosed in Stange allow the tube to assume an elliptical shape during bending.

Hamlin U.S. Pat. No. 3,242,710 teaches the use of a clamp die clamped to the tube to be bent, such clamp die progressing the tube to be bent tangentially in the direction of the bending form. In addition to the clamp die disclosed, Hamlin discloses one or more rollers disposed along the tubular stock exterior of the bend, one roller being advanced during the bending process to a location tangential to the bend die.

Robinson U.S. Pat. No. 1,510,162 describes a pipe bending machine having a pair of rotating bending rollers, each roller having concave grooves which correspond to the general shape of the tube to be bent. The tube to be bent is filled with sand prior to bending in the preferred embodiment in order to prevent collapsing of the tube.

Newhall U.S. Pat. No. 2,996,100 discloses a method for restricting the thinning of the tube metal in the outer wall during bending by applying against the outer face of the outer wall a temporary metal section of greater tensile strength than the metal of the pipe. The temporary metal section is bent with the tube.

Robinson U.S. Pat. No. 1,510,162 discloses a pipe bending machine having one or more rollers containing concave grooves contained between plates with a bending block for bending the tube.

Myer, et al. U.S. Pat. No. 3,456,482 describes a mandrel to be placed in a tube, said mandrel including a relatively rigid support member and a wear-resistant member, the wear-resistant member being constructed of plastics, ceramics, or carbides and having an external surface coated with lubricant.

Rothanburger U.S. Pat. No. 4,355,528 discloses a manually operated device for bending metal tube including a short cylindrical segment, a pivotal lever, and a pressing block mounted on the lever. The cylindrical segment has an exterior circumferential groove which determines the bending radius of the tube to be bent.

Kowal U.S. Pat. No. 4,380,922 discloses a manually operated tube bender comprised of a stationary bend die, a forming member which rotates about the bending axis, a lever attached to the stationary bend die, a lever attached to the forming member, a scale on the stationary bend die, and an indicator on the rotating forming member. Movement of the forming member about the bending axis is affected by manipulation of the levers.

Peppers U.S. Pat. No. 4,424,699 discloses a tube bender for manual operation. The tube bender includes a mandrel having a bending groove, a forming member mounted to the mandrel to swing about a bending axis of the bending groove, movement of the forming member about the bending axis is effected by manipulation of a pair of handles.

The current technology as disclosed in the commercial publications and the referenced patents indicate the desirability of providing an elliptical shape in the tube to be bent to reduce thinning in the outer surface of the tube to be bent and to reduce wrinkling along the inner surface.

SUMMARY OF THE INVENTION

It is an object of the present invention to provide an improved apparatus and method for bending tubing to smaller "D" of bends with thinner wall thicknesses without an internal mandrel support.

It is a further object of the present invention to provide an improved apparatus and method for bending the tubing to maintain ovality quality requirements during bending by contorting the tube to more defined curvilinear shapes than currently obtained with conventional pressure die/bend die systems.

It is an object of the present invention to provide a means of preforming the bent tube to form a curvilinear shape of the tube to be bent.

These and other objects of the invention will become apparent from time to time throughout the specification and claims as hereinafter related.

The above noted objects and other objects of this invention are accomplished by providing forming dies adaptable to conventional tube bending machinery, the forming dies including aligned forming rollers engaging the tubing to be bent, said forming rollers containing grooves having curvilinear surfaces corresponding generally with the circumference of the tube to be bent, said forming rollers curvilinear surfaces, said forming rollers initially deforming the said tubing into generally a first curvilinear shape upon the drawing or pushing of the tubing between the forming rollers. A bend die is aligned with a pressure die roller, the pressure die roller and bend die each containing grooves having curvilinear surfaces corresponding generally to the external diameter of the initially-deformed tubing, each of such groove surfaces having a second curvilinear shape. Upon drawing or pushing the tubing through the pressure die roller and bend die, a second curvilinear shape is imparted to the tube.

By preforming of the tubing with the forming rollers into a first curvilinear shape, and further forming the tubing by the pressure die roller and bend die into a second curvilinear shape, the tubing may be provided with an enhanced curvilinear shape, such enhanced shape reduces the lateral pressure required by the pressure die roller, eliminates the need for an internal mandrel or wiper die during bending, provides for reduced thinning of the outer side wall of the tubing, and provides for support to eliminate wrinkling or buckling of the inner side wall of the bent tubing.

DESCRIPTION OF THE PREFERRED EMBODIMENT

Figure 1:
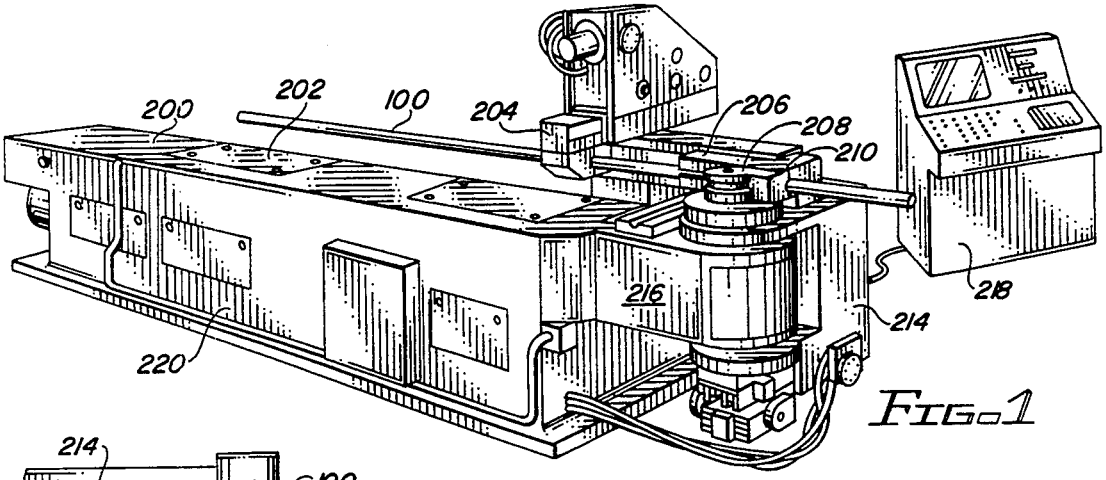
FIG. 1 comprises an outline of a form of tube bending machine illustrating the location of various components of the machine.

Referring first to FIG. 1, a conventional tube bending machine 200 is depicted. Bending machine 200 includes a structure 220 having an elongated lateral upper surface 202, a booster die 204, a pressure die 206, a bend die 208 supported on extension 216 of bending machine 200, a clamp die 210, each of said booster die 204, pressure die 206, bend die 208, and clamp die 210 containing grooved surfaces, the said grooved surfaces generally corresponding to the external diameter of tube 100, such that tube 100 may be horizontally aligned within the grooved surfaces of booster die 204, pressure die 206, bend die 208, and clamp die 210. Clamp die 210 is mounted on swing arm 214, which swing arm 214 is rotatably connected to extension 216 of bending machine 200.

The bending of tube 100 is accomplished by engagement of booster die 204, pressure die 206, bend die 208, and clamp die 210 with tube 100 and by rotation of swing arm 214 about the axis of bend die 208, bend die 208 rotating about its central axis in connection with said rotation. Booster die 204 propels the tube to be bent in the direction of the bend die 208 during the rotational movement of the swing arm 214. As the rotation of bend die 208 draws tube 100 forward during the bending process, booster die 204 is not required in all applications.

Means of movement of booster die 204, positioning and movement means for pressure die 206, positioning means for clamp die 210, and rotating means for rotating swing arm 214 are provided, such means not being detailed within FIG. 1 as such means are known in the art and are not the subject of the present invention. Computer numerical control means 218 for control of the various dies and mechanical and hydraulic means are provided, which control means are additionally known in the art. Alternatively, the dies and mechanical and hydraulic means may be controlled manually.

Figure 2:
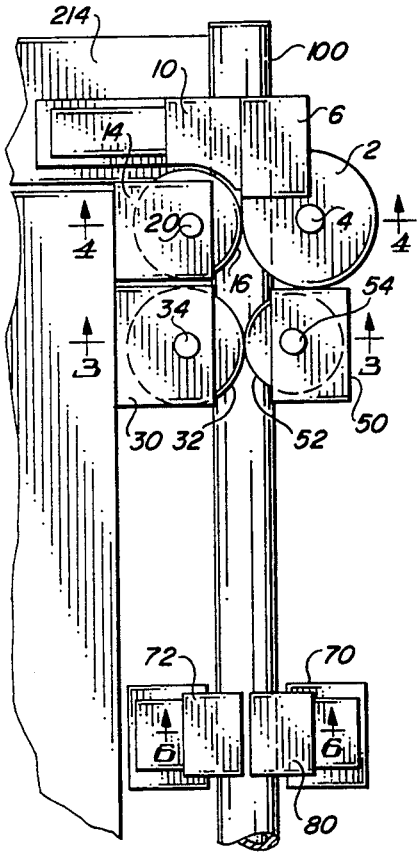
FIG. 2 comprises a plan view depicting forming rollers and dies of the present invention.

Referring now to FIG. 2, a plan view of the apparatus of the present invention is depicted. The apparatus includes bend die 2, clamp die 10, pressure die assembly 14, forming roller assembly 30, and forming roller assembly 50. Tube 100 is horizontally aligned between bend die 2, clamp die 10, and pressure die 14 and between forming roller assembly 30 and forming roller assembly 50.

Figure 4:
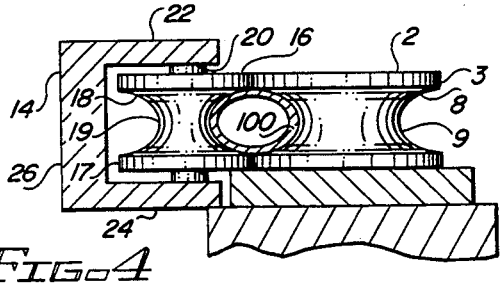
FIG. 4 is a partial cross-sectional view along the lines 4—4 of FIG. 2.

Bend die 2 rotates around a central axis 4. Bend die 2 comprises a generally cylindrical member supported on extension 216 of bending machine structure 200. Bend die 2 is provided with an extension 6 extending tangentially and horizontally. Referring to FIG. 4, curvilinear groove 8 is provided along the circumferential cylinder wall 3 of bend die 2.

Figure 7:
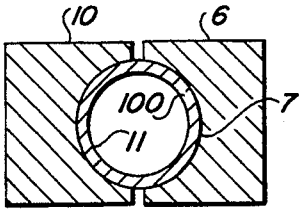
FIG. 7 depicts a cross-sectional view of the clamp die and the bend die extenuation along lines 7—7 of FIG. 2.

Clamp die 10 is located adjacent extension 6. Referring to FIG. 7, clamp die 10 comprises a generally rectangular block having a generally semi-circular groove 11 extending parallel to and opposite groove 7 provided in extension 6. Clamp die 10 is attached to swing arm 214 by attachment bolts (not shown). Rotating means (not shown) are connected to swing arm 214. Upon engagement of such rotating means, swing arm 214 rotates around an axis generally defined by the central axis 4 of bend die 2. The means of rotation and the connection of swing arm 214 with extension 216 of bending machine 200 are not depicted in detail as such mechanisms are currently known in the art.

Figure 5:
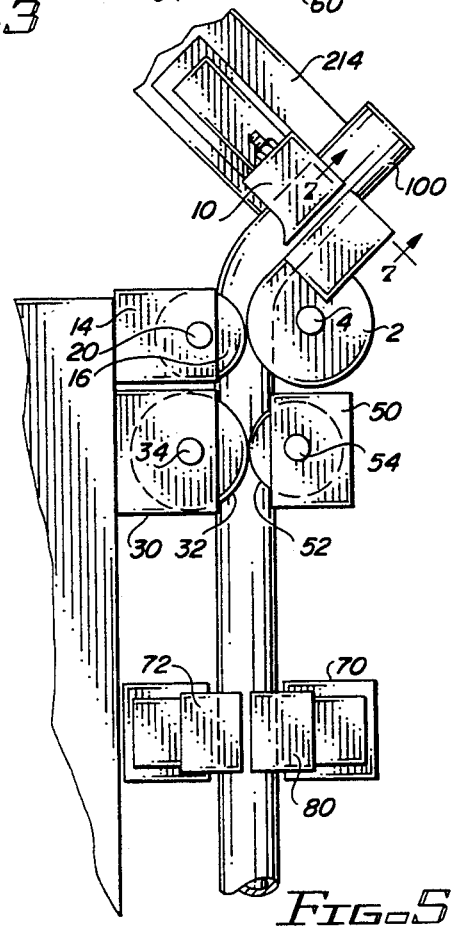
FIG. 5 depicts a plan view of the forming rollers and dies of the present invention upon rotation of the clamp die and bend die.

Referring to FIG. 7, extension 6 is provided with a generally semicircular groove 7 comprising an extension of groove 8 of bending die 2. It is not necessary that the curvilinear groove surface 8 and the generally semicircular groove 7 coincide as variation may be provided in curvilinear groove surface 8 of bend die 2 or in generally semicircular groove 7 to provide transition between the surfaces to align said surfaces. Referring to FIGS. 1, 2 and 5, clamp die 10 and extension 6 co-act to retain tubing 100 between said clamp die 10 and extension 6. Pressure die assembly 14 is mounted on bending machine 200, pressure die assembly 14 including cylindrical roller die 16. Roller die 16 comprises a cylindrical member rotatable about central axle 20, said roller die 16 being horizontally and vertically aligned with bend die 2 and adjacent bend die 2.

Referring to FIG. 4, pressure die assembly 14 includes cylindrical roller die 16 rotatable about central axle 20, said central axle 20 extending between upper wall 22 and lower wall 24, upper wall 22 and lower wall 24 being connected by side wall 26. Curvilinear groove 18 is provided in the cylinder wall 17 of roller die 16, said groove 18 being generally aligned with groove 8 provided in bend die 2. Connection means (not shown) are provided for removably connecting pressure die assembly 14 to bending machine 200. Pressure die assembly 14 and bend die 2 co-act to retain tube 100 between pressure die assembly 14 and bend die 2.

Figure 3:
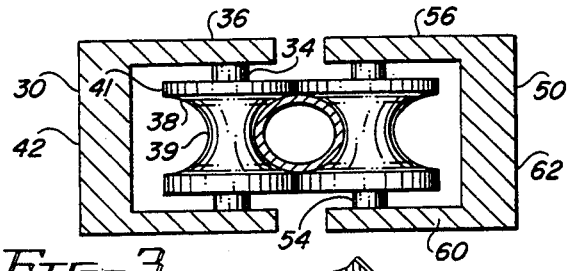
FIG. 3 depicts a partial cross-sectional view along lines 3—3 of FIG. 2.

Referring to FIG. 2, forming roller assembly 30 is horizontally and vertically aligned with pressure die assembly 14, and arranged laterally and adjacent to pressure die assembly 14. Forming roller assembly 30 includes a cylindrical roller die 32. Referring to FIG. 3, roller die 32 is provided with a curvilinear groove 38 in its outer vertical wall 41. Forming roller assembly 30 comprises a cylindrical disk supported on a central axle 34 and rotatable about such central axle 34, central axle 34 being vertically aligned between upper wall 36 and lower wall 40, said upper wall 36 and lower wall 40 being connected by side wall 42.

Forming roller assembly 50 is horizontally and vertically aligned with forming roller assembly 30 and located laterally adjacent forming roller assembly 30. Forming roller assembly 50 includes a cylindrical roller die 52 having a curvilinear groove 58 provided in its outer cylinder wall 61, said curvilinear groove 58 being aligned with groove 38 of roller die 32. Roller die 52 is supported by a central axle 54 between upper wall 56 and lower wall 60, upper wall 56 and lower wall 60 being connected by side wall 62.

Figure 6:
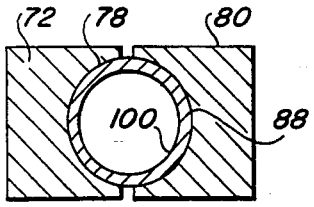
FIG. 6 depicts a cross-sectional view of the booster die along lines 6—6 of FIG. 2.

Referring again to FIG. 2, booster die 70 is depicted, booster die 70 including clamping member 72 and clamping member 80. Clamping member 72 and clamping member 80 are each attached to bending machine 200. Clamping member 72 and clamping member 80 are adjacent and horizontally and vertically aligned. Referring to FIG. 6, a partial cross-sectional view of clamp die 72 and clamp die 80 is depicted. Clamping member 72 is provided with a generally semi-circular groove 78. Clamping member 80 is provided with a generally semicircular groove 88. Groove 78 and groove 88 are provided at the adjacent vertical surfaces of clamping member 72 and clamping member 80. Groove 78 and groove 88 are so sized and aligned in relation to each other and the tube 100 that tube 100 is retained between groove 78 and groove 88.

Booster die 70 is movably attached to bending machine 200. Means of lateral movement of booster die 70 are provided, which means are not shown as they are known in the art. Such means may include a hydraulically activated rod connected to booster die 70.

Bending machine 200 may have power-driven forming roller assemblies 30 and 50 to pull the tube forward during bending or may use booster die 70 to push the tube forward through forming roller dies 32 and 52 during bending. The power source of the forming rollers is not depicted as conventional power means are adequate.

Each of booster die 70, forming roller assembly 30, forming roller assembly 50, pressure die assembly 14, bend die 2, and clamp die 10 are so arranged in relation to each other on the bending machine 200 that a straight section of tube 100 may be inserted between groove 78 and groove 88, between groove 38 and groove 58, between groove 18 and groove 8, and between groove 7 and groove 11.

Referring again to FIG. 3, it may be seen that groove 58 and groove 38 provided in forming roller die 52 and forming roller die 32 do not have a circular radius of curvature. Each of groove 38 and groove 58 have a varying curvature of the groove surface. In the preferred embodiment shown, the interior 39 of groove 38 and the interior 59 of groove 58, each have groove surface curvature less than the external radius of tube 100. The curvature of each of groove 38 and groove 58 decreases from the interior of each groove to the side wall 41 of roller die 32 and the side wall 61 of roller die 52, the groove depth exceeding the external radius of tube 100. In the preferred embodiment shown, the openings of the grooves 38 and 58 are slightly narrower than the external diameter of tube 100. Groove 38 and groove 58 are so constructed in the preferred embodiment to preform the tube 100 into a generally elliptical shape prior to engagement of the tube 100 with the bend die 2 and pressure die assembly 14.

Preforming of the tube 100 is accomplished as tube 100 is pushed or pulled between roller die 32 and roller die 52. The preferred embodiment depicted contemplates that roller die 32 and roller die 52 rotate freely about axle 34 and axle 54. However, roller dies 32 and 52 may be rotated by an external power supply in appropriate applications. Means for rotating the dies are not depicted as conventional power sources are appropriate and known to those skilled in the art.

Referring now to FIG. 4, the radius of curvature of the groove surface of groove 18 provided in roller die 16 is slightly less at the interior 19 of such groove than the corresponding radius of curvature of the external surface of tube 100 at its lateral extension. The radius of curvature of the groove surface of groove 8 provided in bend die 2 is slightly less at the interior 9 than the corresponding radius of curvature of the external surface of tube 100 at its lateral extension. The curvature of each of groove 18 and groove 8 decreases from the interior of each groove to side wall 17 of roller die 18 and to side wall 3 of bend die 2. In the preferred embodiment shown, the openings of the grooves 18 and 8 are slightly narrower than the vertical diameter of the tube 100. It will be noted from FIG. 4 that tube 100 has a generally elliptical cross-section due to preforming by forming roller dies 32 and 52. Each of grooves 8 and 18 are constructed to further shape tube 100 as tube 100 is pushed or pulled between pressure roller die 16 and bend die 2.

Figure 8:
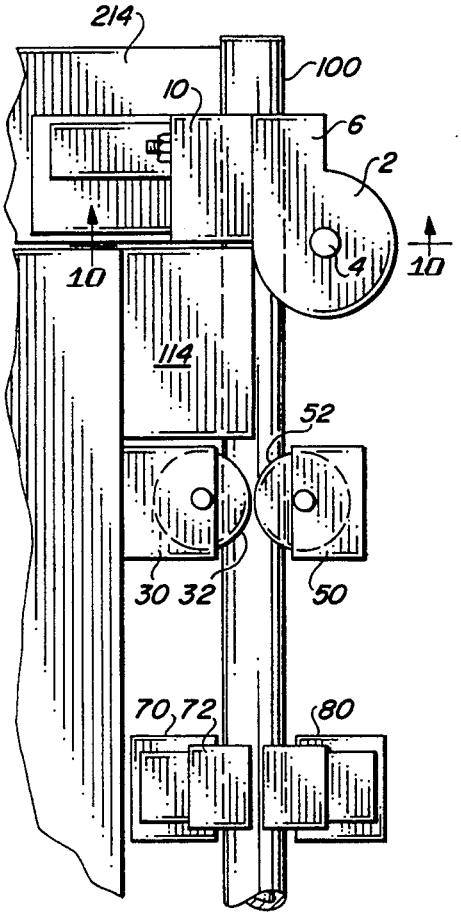
FIG. 8 depicts a plan view of an alternate embodiment of the present invention having a block pressure die.
Figure 9:
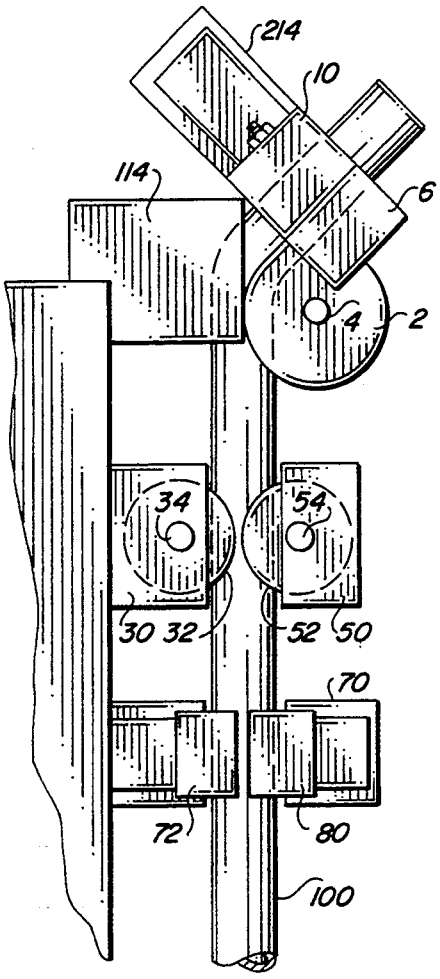
FIG. 9 depicts the embodiment of FIG. 8 upon rotation of the clamp die and bend die.
Figure 10:
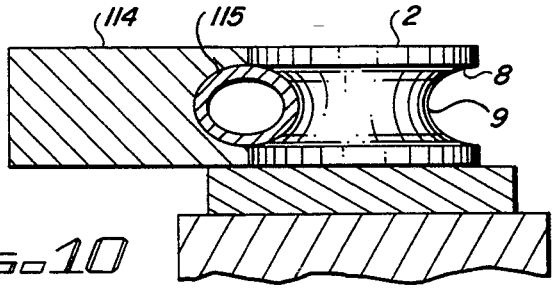
FIG. 10 is a cross-sectional view along lines 10—10 of FIG. 8.

Referring now to FIG. 8, 9, and 10, an alternative embodiment of the present invention is shown. The alternative embodiment includes forming roller assemblies 30 and 50, booster die 70, bend die 2, bend die extension 6, and clamp die 10 as previously described herein. The principal variation of the alternative embodiment is the pressure die 114. Pressure die 114 comprises a generally rectangular block mounted on bending machine 200. Pressure die 114 is aligned horizontally, vertically and laterally with bend die 2. Pressure die 114 is provided with a curvilinear groove 115 in its side wall 116 adjacent bend die 2, said curvilinear groove 115 co-acting with groove 8 of bend die 2 to retain the tube 100 between bend die 2 and pressure die 114. Curvilinear groove 115 of pressure die 114 is, in the embodiment shown, configured in the same cross-sectional configuration as groove 18 of pressure roller die 16 in pressure die assembly 14.

OPERATION

In operation, forming roller assembly 30 and forming roller assembly 50, bend die 2, clamp die 10, and pressure die assembly 14 are each mounted on bending machine 200 such that they are vertically aligned and such that tube 100 extends between opposing grooves 38 and 58, opposing grooves 18 and 8, and opposing grooves 7 and 11. Forming roller assembly 30 and forming roller assembly 50 are laterally forced toward each other thereby engaging tube 100 within opposing grooves 38 and 58. Pressure die assembly 14 is laterally forced against bend die 2 thereby engaging tube 100 within opposing grooves 18 and 8. Clamp die 10 is laterally forced against clamp die extension 6 thereby engaging tube 100 within opposing grooves 7 and 11.

Bend die 2 is rotated about its axis 4 as indicated in FIG. 5, the direction of rotation coinciding with the direction of tangential extension of bend die extension 6. The rotation of bend die 2 and lateral pressure generated by clamp die 10 and bend die extension 6 draw the tube 100 forward between forming roller 32 and forming roller 52 and thence between bend die 2 and pressure roller die 16.

In the preferred embodiment depicted, booster die 70 is fixedly attached to tube 100 by laterally forcing clamp dies 72 and 80 toward each other thereby fixedly engaging tube 100 within grooves 78 and 58. Booster die 70 is linearly advanced toward bend die 2 thereby advancing tube 100 concurrently with the rotation of swing arm 12 about central axis 4 of bend die 2.

In an alternative embodiment of the present invention, the roller dies 32 and 52 of forming roller assemblies 30 and 50 can be powered by an external power source (such as a sprocket and chain drive or an electric motor) to advance tube 100 in a lateral direction toward bend die 2 which may eliminate the need for booster die 70.

In the alternative embodiment depicted in FIGS. 8, 9 and 10, roller pressure die assembly 14 is replaced by block die 114 the operation being otherwise the same as the preferred embodiment depicted. Referring to FIG. 9, the pressure die 114 advances with the tube 100 during the bending procedure. Such concurrent movement reduces friction on the tube 100.

The embodiments presented depict an initially circular tube preformed by forming roller dies 32 and 52 into an elliptical shape, then further formed into a flatter elliptical shape by bend die 2 and pressure roller die 14 (114 in the alternative embodiment). Although an elliptical shape is favored by many practitioners, the present invention may be used to preform and thence further form tubing into a variety of cross-sectional configurations.

I claim:

1. In a tube bending machine including a support structure, a pressure die, a bend die, and a co-operating clamp die, an improvement comprising:

first forming means engaging a tube section prior to engagement of said tube section with said bend die and said clamp die, said first forming means forming said tube section into a first non-circular cross-sectional configuration prior to engagement of said tube section with said clamp die and said bend die;

said first forming means comprising a first roller die and a second roller die;

said first roller die and said second roller die having confronting faces, confronting roller die grooves provided in each of said roller die confronting faces for embracing opposed sides of the tube section;

said roller die grooves being formed in a determined configuration;

whereby pressure exerted by said first roller die and said second roller die imparts a first non-circular cross-sectional configuration to the tube section passing between said first roller die and said second roller die.

2. An improvement to a tube bending machine according to claim 1 wherein said first cross-sectional configuration comprises an elliptic curvilinear tube section wall structure.

3. In a tube bending machine including a support structure, a pressure die, a bend die, and a co-operating clamp die, an improvement comprising:

first forming means engaging a tube section prior to engagement of said tube section with said bend die and said clamp die, said first forming means forming said tube section from a generally circular cross-sectional configuration into a first non-circular cross-section configuration prior to engagement of said tube section with said clamp die and said bend die;

said bend die comprising a bend die disk and a bend die extension extending tangentially from said bend die;

said bend die and said clamp die rotatable about a bend die axis;

said bend die extension and said clamp die having confronting faces, confronting grooves provided in each of said confronting faces for embracing opposed sides of said tube;

said first forming means comprising a first roller die and a second roller die;

said first roller die and said second roller die having confronting faces, confronting roller die grooves provided in said first and second roller die confronting faces for embracing opposed sides of said tube section;

said confronting roller die grooves formed in a determined non-circular configuration, whereby the pressure of said first roller die and said second roller die on said tube section imparts said first non-circular cross-sectional configuration to the tube section passing between said first roller die and said second roller die, said first non-circular cross-sectional configuration conforming to the configuration of said confronting roller die grooves.

4. An improvement to a tube bending machine according to claim 3 including said pressure die and said bend die disk comprising second forming means, said pressure die including a roller pressure die having a circular disk rotatable about a roller pressure die axis, said roller pressure die and said bend die disk having confronting faces, confronting grooves provided in said confronting faces for embracing the tube section to be bent prior to engagement of said tube section with said clamp die and said bend die extension, said pressure die confronting groove and said bend die disk confronting groove each being formed in a determined, non-circular configuration, whereby the pressure exerted by said pressure die and said bend die disk on said tube section imparts a second non-circular cross-sectional configuration to the tube section passing between said pressure die and said bend die disk, said second non-circular cross-sectional configuration conforming to the configuration of said pressure die confronting groove and said bend die disk confronting groove.

5. An improvement to a tube bending machine according to claim 4 wherein said first cross-sectional configuration comprises a curvilinear wall structure and said second cross-sectional configuration comprises a second curvilinear wall structure;

said second cross-sectional configuration comprising a predetermined configuration for the tube section to be bent; and said first cross-sectional configuration intermediate said generally circular tube cross-sectional configuration and said second cross-sectional configuration.

6. An improvement to a tube bending machine according to claim 5 including booster die means engaging said tube prior to engagement of the tube section with said forming means, said booster die means advancing said tube section through said forming means and between said bend die means and said clamp die.

7. An improvement to a tube bending machine according to claim 4 wherein said first cross-sectional configuration comprises a first curvilinear elliptic wall structure and said second cross-sectional configuration comprises a second curvilinear elliptic wall structure;

said second elliptic wall structure having a longer major axis than a major axis of said first elliptic wall structure; and said second elliptic wall structure having a shorter minor axis than a minor axis of said first elliptic wall structure.

8. An improvement to a tube bending machine according to claim 7 wherein booster die means engaging said tube prior to engagement of the tube section with said forming means, said booster die means advancing said tube section through said forming means and between said bend die means and said clamp die.

9. In a tube bending machine including a support structure, a pressure die, a bend die and a co-operating clamp die, an improvement comprising:

first forming means engaging a tube section prior to engagement of said tube section with said bend die and said clamp die, said first forming means forming said tube section from a generally circular cross-sectional configuration into a first non-circular cross-sectional configuration prior to engagement of said tube section with said clamp die and said bend die;

said first forming means comprising a first roller die and a second roller die;

said first roller die and said second roller die having confronting faces, confronting roller die grooves provided in each of said roller die confronting faces for embracing opposed sides of the tube section;

said roller die grooves being formed in a determined configuration;

said bend die including a bend die disk and a tangentially-extending bend die extension;

said bend die and said clamp die rotatable about a bend die axis;

said bend die extension and said clamp die having confronting faces, confronting grooves provided in said confronting faces for embracing opposed sides of said tube;

said pressure die comprising a generally rectangular block pressure die;

said bend die disk and said block pressure die comprising second forming means;

said bend die disk and said block pressure die having confronting faces;

a non-circular curvilinear pressure die groove provided in said block pressure die confronting face;

a non-circular curvilinear bend die groove provided in said bend die confronting face;

said tube section engaged between said block pressure die groove and said bend die groove;

whereby the pressure exerted by said block pressure die and said bend die disk on a tube section imparts a second non-circular cross-sectional configuration to the tube section passing between said pressure die and said bend die disk;

said second non-circular cross-sectional configuration comprising a predetermined configuration for the tube to be bent; and said first cross-sectional configuration intermediate a circular cross-sectional configuration and said second cross-sectional configuration.

10. An improvement to a tube bending machine according to claim 9 including said first cross-sectional configuration comprises a first curvilinear elliptic wall structure and said second cross-sectional configuration comprises a second curvilinear elliptic wall structure;

said second elliptic wall structure having a longer major axis than a major axis of said first elliptic wall structure; and said second elliptic wall structure having a shorter minor axis than a minor axis of said first elliptic wall structure.

11. An improvement to a tube bending machine according to claim 9 including booster die means engaging said tube prior to engagement of the tube section with said forming means, said booster die means advancing said tube section through said forming means and between said bend die means and said clamp die.

* * * * *